US006745495B1

(12) United States Patent
Riddle et al.

(10) Patent No.: US 6,745,495 B1
(45) Date of Patent: Jun. 8, 2004

(54) CLOTHES DRYER APPARATUS AND METHOD

(75) Inventors: Douglas Allen Riddle, Louisville, KY (US); Jeremy Michael Green, Louisville, KY (US); James Alan Meyer, Louisville, KY (US); Emile Edward Abi-Habib, Louisville, KY (US); Zubair Hameed, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/608,044

(22) Filed: Jun. 27, 2003

(51) Int. Cl.[7] ..... F26B 3/00

(52) U.S. Cl. ..... 34/497; 34/493; 34/499; 34/554; 34/558; 34/606

(58) Field of Search ..... 34/445, 486, 492, 34/493, 497, 499, 554, 558, 565, 604, 606

(56) References Cited

U.S. PATENT DOCUMENTS

| | | | | | |
|---|---|---|---|---|---|
| 3,909,955 | A | * | 10/1975 | Janke | 34/531 |
| 4,086,707 | A | | 5/1978 | Bochan | |
| 4,231,166 | A | * | 11/1980 | McMillan | 34/553 |
| 4,338,730 | A | | 7/1982 | Tatsumi et al. | |
| 4,689,896 | A | | 9/1987 | Narang | |
| 4,891,892 | A | | 1/1990 | Narang | |
| 5,443,541 | A | * | 8/1995 | St. Louis | 34/486 |
| 6,141,887 | A | * | 11/2000 | Chen et al. | 34/475 |
| 6,199,300 | B1 | * | 3/2001 | Heater et al. | 34/446 |
| 6,647,643 | B2 | * | 11/2003 | Song et al. | 34/595 |

* cited by examiner

*Primary Examiner*—Pamela A. Wilson
(74) *Attorney, Agent, or Firm*—George Rideout, Esq.; Armstrong Teasdale LLP

(57) ABSTRACT

A dryer tumble drying articles includes a drum including a cavity configured to hold articles to be dried, a first motor drivingly coupled to the drum to rotate the drum, a heat source in flow communication with the cavity, and a variable speed motor drivingly coupled to a blower positioned to deliver heated air from the heat source to the cavity.

24 Claims, 3 Drawing Sheets

CLOTHES DRYER APPARATUS AND METHOD

BACKGROUND OF THE INVENTION

This invention relates generally to clothes dryers and, more specifically, to a variable speed blower for clothes dryers.

An appliance for drying articles such as a clothes dryer typically includes a cabinet including a rotating drum for tumbling clothes and laundry articles therein. One or more heating elements heat air prior to the air entering the drum. The warm air is circulated through the drum as the clothes and laundry items are tumbled to remove moisture from the articles in the drum. See, for example, U.S. Pat. No. 6,141,887.

At least one known clothes dryer utilizes an open loop control system to determine an appropriate amount of time for drying a load of clothes. The drying time is determined by an operator and entered using a manual control, such as a time selector switch. For the duration of the drying time, the heating elements are activated and deactivated to maintain warm air circulation inside the drum, and for more accurate control of the dryer heating elements, a temperature sensor is sometimes used in conjunction with the heating elements. The operator selects a drying time based on the desired dryness for the clothes and based on past experience with the particular machine. A longer drying time than is necessary to fully dry the clothes is commonly selected to ensure that the clothes are fully dried. Use of more time than is needed for effective drying, however, is wasteful.

While heating elements are often controlled to adjust air temperature, the blower on known residential dryers is driven at a constant speed for the total drying time. This constant speed may not facilitate lowering drying time, improving dryer efficiency, and reducing electrical energy consumption. Drying time is affected by the amount of heat that can be delivered to the clothes, which is influenced by airflow through the dryer. Airflow, in turn, is affected by many parameters, such as, ducting length and the number of bends, load size, lint filter condition, etc.

BRIEF DESCRIPTION OF THE INVENTION

In one aspect, a dryer for tumble drying articles includes a drum including a cavity configured to hold articles to be dried, a first motor drivingly coupled to the drum to rotate the drum, a heat source in flow communication with the cavity, and a variable speed motor drivingly coupled to a blower positioned to deliver heated air from the heat source to the cavity.

In another aspect, a blower control system for a tumble type dryer having a variable speed blower motor driving the blower to supply heated air to the dryer cavity through a cavity inlet and exhaust air from the dryer cavity through a cavity outlet includes at least one temperature sensor positioned to sense a temperature associated with the dryer and generate a temperature signal representative of the sensed temperature, at least one pressure sensor positioned to sense a pressure associated with the dryer and generate a pressure signal representative of the sensed pressure, and a controller operatively coupled to the at least one temperature sensor and the at least one pressure sensor and configured to receive the temperature and pressure signals and control the operation of the variable speed blower motor based on at least one of the received signals.

In yet another aspect, a method for controlling a variable speed blower for a clothes dryer includes installing a controller on the dryer in communication with at least one temperature sensor and at least one pressure sensor, receiving a signal in the controller from the at least one temperature and pressure sensors, and controlling the blower motor based on at least one of the received temperature and pressure signals.

DETAILED DESCRIPTION OF THE INVENTION

Figure 1:
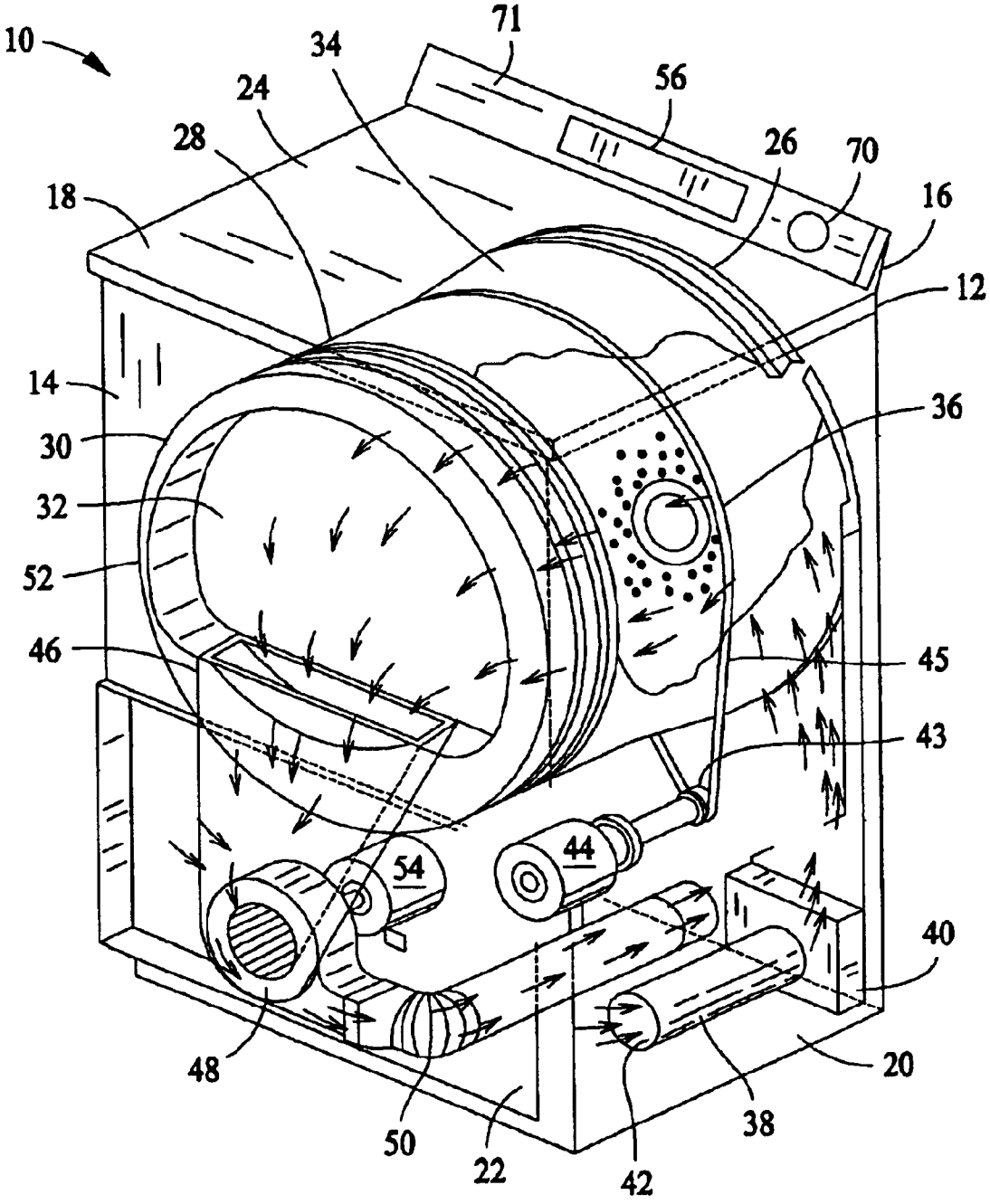
FIG. 1 is perspective broken away view of an exemplary dryer appliance.

FIG. 1 illustrates an exemplary clothes dryer appliance 10 in which the herein described methods and apparatus may be practiced. While described in the context of a specific embodiment of dryer 10, it is recognized that the benefits of the herein described methods and apparatus may accrue to other types and embodiments of dryer appliances. Therefore, the following description is set forth for illustrative purposes only, and the herein described methods and apparatus is not intended to be limited in practice to a specific embodiment of a dryer appliance, such as dryer 10.

Clothes dryer 10 includes a cabinet or a main housing 12 including a front panel 14, a rear panel 16, a pair of side panels 18 and 20 spaced apart from each other by front panel 14 and rear panel 16, a bottom panel 22, and a top cover 24. Within cabinet 12 is a drum or container 26 mounted for rotation around a substantially horizontal axis. A motor 44 rotates drum 26 about the horizontal axis through a pulley 43 and a belt 45. Drum 26 is generally cylindrical in shape, having an imperforate outer cylindrical wall 28 and a front flange or wall 30 defining an opening 32 to drum 26 for loading and unloading of clothing articles and other fabrics.

A plurality of tumbling ribs (not shown) are provided within drum 26 to lift clothing articles therein and then allow them to tumble back to the bottom of drum 26 as the drum rotates. Drum 26 includes a rear wall 34 rotatably supported within the main housing 12 by a suitable fixed bearing. Rear wall 34 includes a plurality of holes 36 that receive hot air that has been heated by an electrical heater 40 in communication with an air supply duct 38 and duct inlet 42. The heated air is drawn from the drum 26 by a blower fan 48 which is driven by a blower motor 54. The air passes through a screen filter 46 which traps any lint particles. As the air passes through the screen filter 46, it enters a trap duct seal and is passed out of the clothes dryer through an exhaust duct 50. After the clothing articles have been dried, they are removed from drum 26 via opening 32.

A cycle selector knob 70 is mounted on a cabinet backsplash 71 and is in communication with a control system 56. Signals generated in control system 56 operate drum 26 and heating elements 40 in response to a position of selector knob 70. Blower motor 54 is a variable speed motor that is controlled by control system 56.

Figure 2:
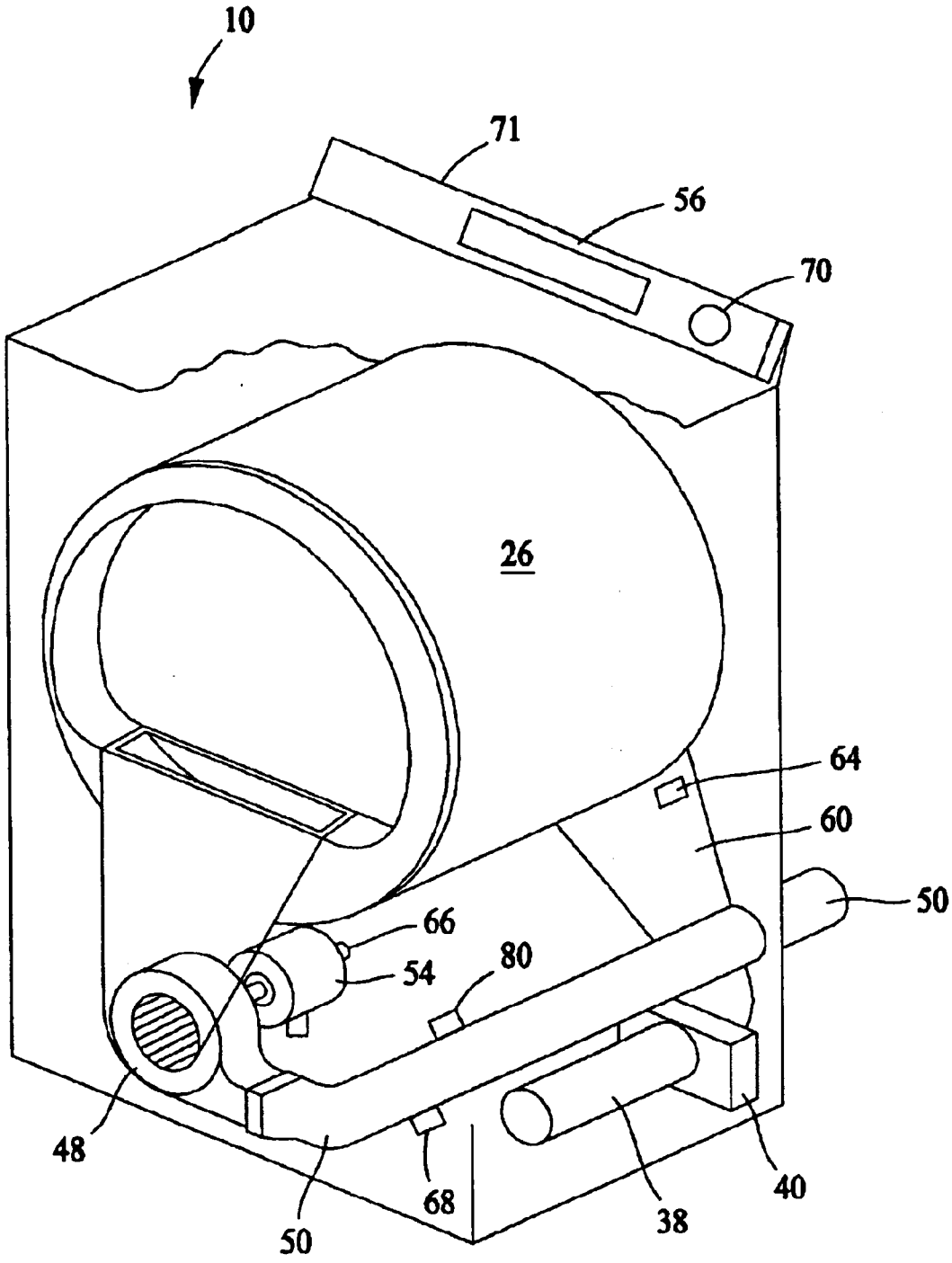
FIG. 2 is a perspective broken away view of a dryer appliance showing sensor locations.

With reference to FIG. 2, dryer 10 includes a temperature sensor 64 at drum hot air inlet 60 operable to produce a temperature signal indicative of an inlet air temperature. A second temperature sensor 68 is operable to produce a temperature signal indicative of a drum outlet temperature in outlet duct 50. A pressure sensor 80 is operable to produce a pressure signal indicative of air pressure in outlet duct 50. An inverter 66 regulates the frequency of the electric current supplied to motor 54 to control the operation of motor 54.

Figure 3:
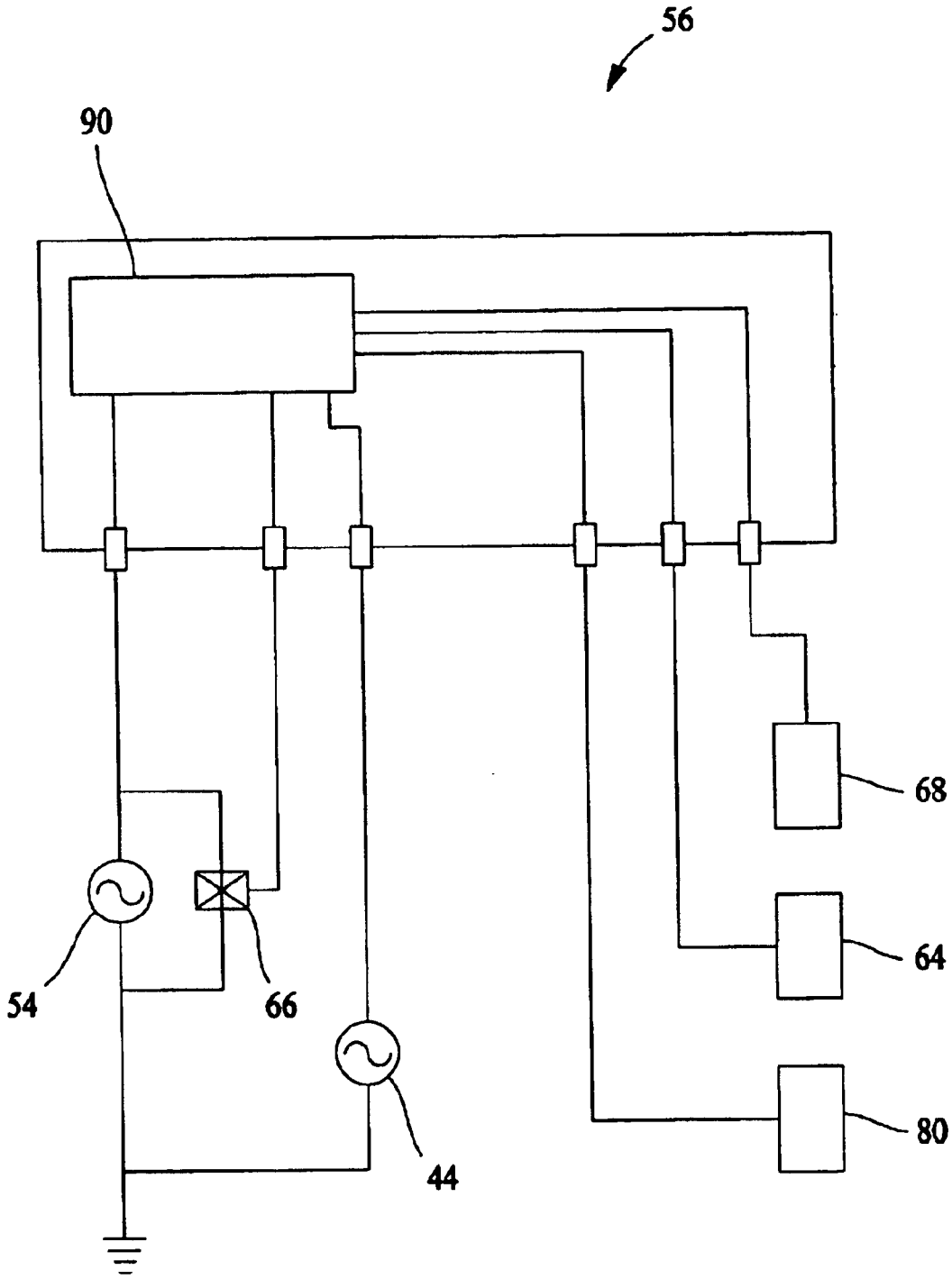
FIG. 3 is a schematic diagram of a controller control circuit for controlling a blower in a dryer.

FIG. 3 is a schematic block diagram of control system 56 including a controller 90 which is in communication with temperature sensors 64 and 68 and pressure sensor 80. Controller 90 also is in communication with drum motor 44, inverter 66, and variable speed motor 54. Controller 90 is programmed to perform functions described herein, and as used herein, the term controller is not limited to just those integrated circuits referred to in the art as controllers, but broadly refers to microprocessors, computers, processors, microcontrollers, microcomputers, programmable logic controllers, application specific integrated circuits, field programmable gate arrays, and other programmable circuits, and these terms are used interchangeably herein.

In operation, a user selects a drying cycle through control system 56. Controller 90 then controls motor 54 to vary the speed of blower fan 48. Controller 90 contains multiple program algorithms associated with the drying options available to the user through control system 56. For example, in one drying cycle controller 90 directs inverter 66, controlling the duty cycle of inverter 66, to maintain blower fan 48 at a constant speed. For another drying cycle, controller 90 directs inverter 66 to vary the speed of blower fan 48 based on temperature feedback from one or both of temperature sensors 64 and 68. For another drying cycle, controller 90 signals inverter 66 to vary the speed of blower fan 48 based on pressure feedback from pressure sensor 80.

In another embodiment, controller 90 directs inverter 66 to operate motor 54 at a constant torque. In this mode, inverter 66 is similar to a pressure sensor in that inverter 66 automatically responds to varying pressures. Factors that affect pressure within duct 50 include lint buildup or a length of outlet duct 50, including the venting distance to the outside of the home for establishing an optimal drying time. In another drying cycle, an algorithm directs controller 90 to control motor 54 based on a combination of temperature signals from drum inlet temperature sensor 64 and drum outlet temperature sensor 68 and pressure sensor 80 to vary airflow from blower fan 48 to facilitate a reduction in drying time.

In another embodiment, controller 90 is programmed to determine a ducting pressure loss based on the pressure signal from pressure sensor 80 and regulate the operation of motor 54 based on the determined ducting pressure loss. In one embodiment, controller 90 regulates the operation of motor 54 based on the outlet temperature of drum 26 to maintain a constant inlet air temperature setpoint for drum 26. In yet another drying cycle, controller 90 is programmed to regulate the operation of motor 54 based on a signal indicative of clothes load (e.g. weight) in drum 26.

Optionally, motor 54 may be a self governing motor that varies speed based on load such as a high slip induction motor. In this case, the dryer would not include an inverter.

From the preceding, it is shown that various methods are available to control variable speed blower motor 54. In an exemplary embodiment, control system 56 receives a signal from temperature sensor 68 and pressure sensor 80, and control system 56 controls the operation of blower motor 54 based on the received pressure and temperature signals. One method also includes controlling blower motor 54 based on the load size in drum 26. Load size can be selectively set by the user or automatically determined by measuring an increase of the weight of drum 26 due to the clothes load. One method also includes controlling blower motor 54 to maintain a constant inlet air setpoint for the dryer.

In describing one method in more detail, controller 90 executes one of several algorithms stored therein to control blower motor 54 based on the selection of a drying cycle by the user of the dryer. Controller 90 controls the operation of blower motor 54 based on the received temperature and pressure signals and load size indications. In one embodiment, inverter 66 is operatively coupled to blower motor 54 wherein control of blower motor 54 is accomplished by controlling the duty cycle of inverter 66 based on temperature. In an exemplary embodiment, control system 56 directs inverter 66 to control motor 54 at a constant torque and varies the duty cycle to inverter 66 based upon sensed temperature to adapt to different pressures for different ducting conditions while also controlling inverter 66 based on temperature.

The embodiments thus described provide a clothes dryer with a variable speed blower motor that allows the dryer to be operated in a manner that facilitates improving dryer efficiency, reducing energy consumption, and lowering drying time which also facilitates extending the useful life of the dryer. In varying the blower speed, the capability is provided to compensate for such factors as ducting length and the number of bends, load size and lint filter conditions to facilitate delivering more heat to the clothes.

While the invention has been described in terms of various specific embodiments, those skilled in the art will recognize that the invention can be practiced with modification within the spirit and scope of the claims.

What is claimed is:

1. A dryer for tumble drying articles comprising:

a drum comprising a cavity configured to hold articles to be dried;

a first motor drivingly coupled to said drum to rotate said drum;

a heat source in flow communication with said cavity; and a variable speed motor drivingly coupled to a blower positioned to deliver heated air from said heat source to said cavity.

2. A dryer in accordance with claim 1 further comprising a control operatively coupled to said variable speed motor to control at least one operating parameter of said variable speed motor in a fixed state.

3. A dryer in accordance with claim 2 wherein said operating parameter is motor speed.

4. A dryer in accordance with claim 2 wherein said operating parameter is motor torque.

5. A dryer in accordance with claim 1 further comprising:

an outlet duct in flow communication with said cavity; and a pressure sensor positioned to sense air pressure within said duct, said sensor configured to generate a signal representative of the sensed air pressure.

6. A dryer in accordance with claim 5 further comprising a controller responsive to the signal from said pressure sensor operationally coupled to said pressure sensor.

7. A dryer in accordance with claim 2 further comprising a temperature sensor positioned to sense an air temperature associated with said cavity, said sensor configured to generate a signal representative of the sensed air temperature.

8. A dryer in accordance with claim 7 further comprising a controller responsive to the signal from said temperature sensor operationally coupled to said temperature sensor.

9. A dryer in accordance with claim 7 further comprising an air inlet in flow communication with said cavity positioned between said cavity and said heat source, said temperature sensor positioned within said air inlet.

10. A dryer in accordance with claim 7 further comprising an air outlet in flow communication with said cavity, said temperature sensor positioned within said air outlet.

11. A dryer in accordance with claim 1 wherein said variable speed motor comprises a self governing motor.

12. A blower control system for a tumble type dryer having a variable speed blower motor driving the blower to supply heated air to the dryer cavity through a cavity inlet and exhaust air from the dryer cavity through a cavity outlet, said system comprising:

at least one temperature sensor positioned to sense a temperature associated with the dryer and configured to generate a temperature signal representative of the sensed temperature;

at least one pressure sensor positioned to sense a pressure associated with the dryer and configured to generate a pressure signal representative of the sensed pressure; and a controller operatively coupled to said at least one temperature sensor and said at least one pressure sensor and configured to receive the temperature and pressure signals and control the operation of the variable speed blower motor based on at least one of the received signals.

13. A blower control system in accordance with claim 12 wherein the temperature signal is representative of cavity inlet air temperature.

14. A blower control system in accordance with claim 12 wherein the temperature signal is representative of cavity outlet air temperature.

15. A blower control system in accordance with claim 12 wherein said controller regulates the operation of the variable speed blower motor based on the temperature signal to maintain a substantially constant inlet air temperature setpoint for the cavity.

16. A blower control system in accordance with claim 12 wherein said controller is configured to receive a signal representative of clothes load and regulate the operation of the variable speed blower motor based on the clothes load signal.

17. A blower control in accordance with claim 12 further comprising an inverter operatively coupled to the variable speed blower motor and configured to control an operating parameter of the variable speed blower motor.

18. A blower control in accordance with claim 17 wherein said controller controls a duty cycle of said inverter.

19. A blower control in accordance with claim 18 wherein said operating parameter is motor speed.

20. A blower control in accordance with claim 18 wherein said operating parameter is motor torque.

21. A method for controlling a variable speed blower for a clothes dryer, said method comprising:

installing a controller on the dryer in communication with at least one temperature sensor and at least one pressure sensor;

receiving a signal in the controller from the at least one temperature and pressure sensors; and controlling the blower motor based on at least one of the received temperature and pressure signals.

22. A method in accordance with claim 21 wherein said controlling the blower motor further comprises controlling the blower motor based on a dryer load size.

23. A method in accordance with claim 22 wherein said controlling the blower motor further comprises controlling the blower motor to maintain a substantially constant inlet air temperature setpoint for the dryer.

24. A method in accordance with claim 22 wherein said controlling the blower motor comprises controlling a duty cycle of an inverter operationally coupled to the blower motor.

* * * * *

US006745495C1

(12) EX PARTE REEXAMINATION CERTIFICATE (6011th)

United States Patent

Riddle et al.

(10) Number: US 6,745,495 C1

(45) Certificate Issued: *Nov. 13, 2007

(54) CLOTHES DRYER APPARATUS AND METHOD

(75) Inventors: Douglas Allen Riddle, Louisville, KY (US); Jeremy Michael Green, Louisville, KY (US); James Alan Meyer, Louisville, KY (US); Emile Edward Abi-Habib, Louisville, KY (US); Zubair Hameed, Louisville, KY (US)

(73) Assignee: General Electric Company, Schenectady, NY (US)

Reexamination Request:
No. 90/007,734, Sep. 27, 2005

Reexamination Certificate for:

| | |
|---|---|
| Patent No.: | **6,745,495** |
| Issued: | **Jun. 8, 2004** |
| Appl. No.: | **10/608,044** |
| Filed: | **Jun. 27, 2003** |

( * ) Notice: This patent is subject to a terminal disclaimer.

(51) Int. Cl.
*F26B 3/00* (2006.01)

(52) U.S. Cl. ..... 34/497; 34/493; 34/499; 34/554; 34/558; 34/606

(58) Field of Classification Search ..... 34/445, 34/486, 492, 493, 497, 499, 554, 558, 565, 34/604, 606
See application file for complete search history.

(56) References Cited

U.S. PATENT DOCUMENTS

| | | | | |
|---|---|---|---|---|
| 3,266,168 | A | 8/1966 | Sones et al. | |
| 5,050,313 | A | 9/1991 | Wakaeya et al. | |
| 6,643,953 | B2 | 11/2003 | Song et al. | |
| 6,691,536 | B2 | 2/2004 | Severns et al. | |
| 6,785,981 | B1 | 9/2004 | Harpenau | |
| 7,017,280 | B2 * | 3/2006 | Green et al. | 34/499 |

FOREIGN PATENT DOCUMENTS

| | | |
|---|---|---|
| DE | 196 13 310 | 10/1996 |
| JP | 03-178699 | 8/1991 |
| JP | 04-193298 | 7/1992 |

* cited by examiner

*Primary Examiner*—Sara Clarke

(57) ABSTRACT

A dryer tumble drying articles includes a drum including a cavity configured to hold articles to be dried, a first motor drivingly coupled to the drum to rotate the drum, a heat source in flow communication with the cavity, and a variable speed motor drivingly coupled to a blower positioned to deliver heated air from the heat source to the cavity.

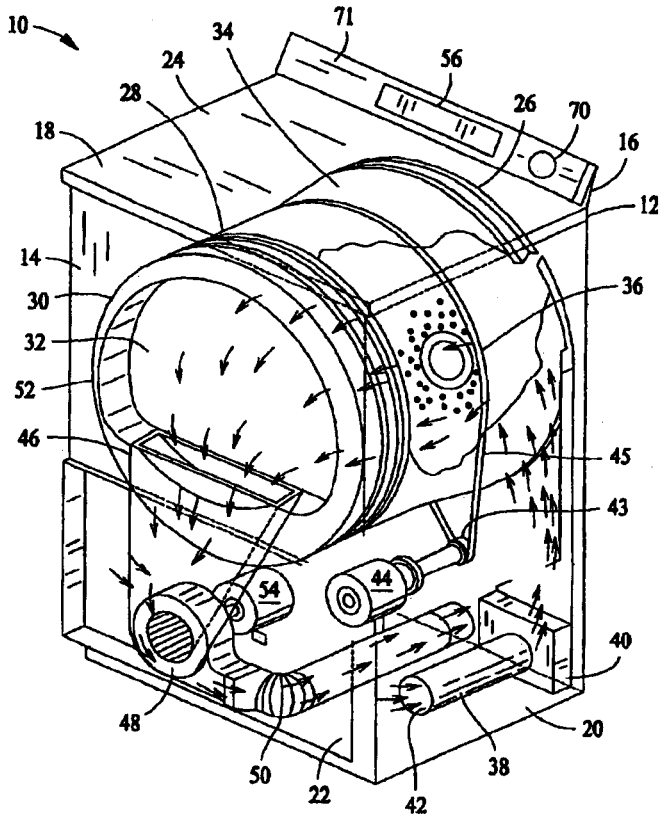

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 12–24 is confirmed.

Claim 7 is cancelled.

Claims 1, 2, 6, 8, 9 and 10 are determined to be patentable as amended.

Claims 3, 4, 5 and 11, dependent on an amended claim, are determined to be patentable.

New claims 25 and 26 are added and determined to be patentable.

1. A dryer for tumble drying articles comprising:

a drum comprising a cavity configured to hold articles to be dried;

a first motor drivingly coupled to said drum to rotate said drum;

a heat source in flow communication with said cavity; [and]

a variable speed motor drivingly coupled to a blower positioned to deliver heated air from said heat source to said cavity*;*

*a first temperature sensor positioned with respect to an outlet of said cavity to sense an air temperature associated with said cavity and configured to generate a temperature signal representative of the sensed temperature; and*

*a controller operatively coupled to said first temperature sensor, said controller configured to receive the temperature signal and control the operation of said variable speed motor based at least partially on the received temperature signal to maintain a substantially constant inlet air temperature setpoint for said cavity for at least a portion of a drying cycle.*

2. A dryer in accordance with claim 1 [further comprising a control] *wherein said controller is* operatively coupled to said variable speed motor to control at least one operating parameter of said variable speed motor in a fixed state.

6. A dryer in accordance with claim 5 [further comprising a] *wherein said* controller responsive to the signal from said pressure sensor *is* operationally coupled to said pressure sensor.

8. A dryer in accordance with claim [7 further comprising a] *1 wherein said* controller responsive to the signal from said *first* temperature sensor *is* operationally coupled to said *first* temperature sensor.

9. A dryer in accordance with claim [7] *1* further comprising an air inlet in flow communication with said cavity positioned between said cavity and said heat source, [said ] *a second temperature sensor* positioned within said air inlet.

10. A dryer in accordance with claim [7] *1* further comprising an air outlet in flow communication with said cavity, said *first* temperature sensor positioned within said air outlet.

*25. A dryer for tumble drying articles comprising:*

*a drum comprising a cavity configured to hold articles to be dried;*

*a first motor drivingly coupled to said drum to rotate said drum;*

*a heat source in flow communication with said cavity;*

*a variable speed motor drivingly coupled to a blower positioned to deliver heated air from said heat source to said cavity; and*

*a controller operatively coupled to said variable speed motor to control motor torque in a fixed state.*

*26. A dryer for tumble drying articles comprising:*

*a drum comprising a cavity configured to hold articles to be dried;*

*a first motor drivingly coupled to said drum to rotate said drum;*

*a heat source in flow communication with said cavity; and*

*a variable speed motor drivingly coupled to a blower positioned to deliver heated air from said heat source to said cavity, said variable speed motor comprising a self governing motor.*

* * * * *